US006085353A

United States Patent [19]

van der Sleesen

[11] Patent Number: 6,085,353

[45] Date of Patent: *Jul. 11, 2000

[54] VENTILATED GARMENTS

[75] Inventor: Michael F. van der Sleesen, West Hartford, Conn.

[73] Assignee: Vanson Leathers, Inc., Fall River, Mass.

[ * ] Notice: This patent is subject to a terminal disclaimer.

[21] Appl. No.: 09/251,312

[22] Filed: Feb. 17, 1999

Related U.S. Application Data

[60] Provisional application No. 60/075,397, Feb. 20, 1998.

[51] Int. Cl.[7] ..... A41D 1/02

[52] U.S. Cl. ..... 2/69; 2/108; 2/93; 2/85

[58] Field of Search ..... 2/69, 69.5, 85, 2/93, 94, 108, 87, DIG. 1, 79, 102, 115

[56] References Cited

U.S. PATENT DOCUMENTS 2,715,226 8/1955 Weiner .
4,185,327 1/1980 Markve .
4,513,451 4/1985 Brown .
4,608,715 9/1986 Miller et al. .
4,722,099 2/1988 Kratz .
5,105,477 4/1992 Golde .
5,507,042 4/1996 van der Sleesen .
5,704,064 1/1998 van der Sleesen .

OTHER PUBLICATIONS

PCT International Search Report of International Application No. PCT/US99/03618.

*Primary Examiner*—Gloria M. Hale
*Attorney, Agent, or Firm*—McDermott Will & Emery

[57] ABSTRACT

The invention provides a ventilated garment having at least one vent region with a removable cover element disposed over the vent region. The cover element may include an interior compartment for storage of change, keys and the like. The invention also provides a ventilated garment having vent regions which may open and close in response to the orientation of the vented portions of the garment.

25 Claims, 7 Drawing Sheets

FIG. 5A
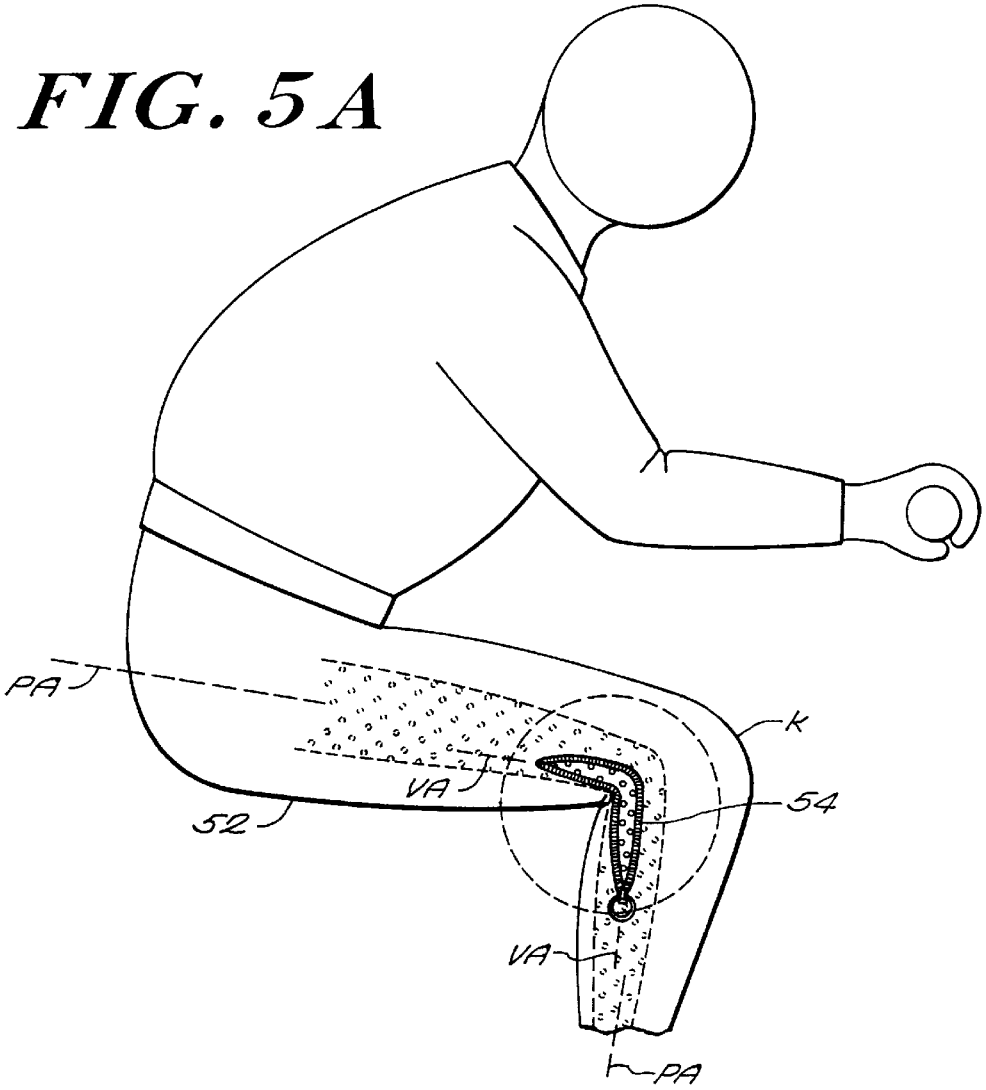
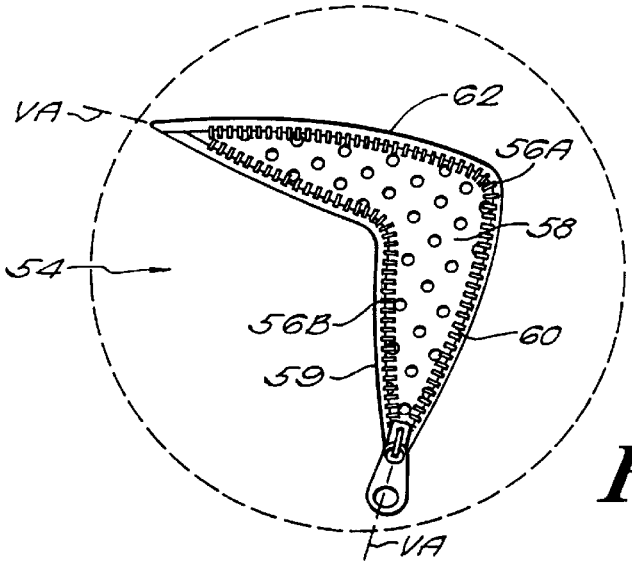
FIG. 5B

VENTILATED GARMENTS

RELATED APPLICATIONS

This application is related to, and claims the benefit of priority of, commonly-owned and co-pending U.S. Provisional Application Ser. No. 60/075,397, filed on Feb. 20, 1998 and entitled "Improvements In Ventilated Garments", which is hereby incorporated by reference.

TECHNICAL FIELD

This invention is related to ventilated garments, and in particular to improvements made in the comfort, fit and utility of such garments.

BACKGROUND OF THE INVENTION

Ventilated protective garments, such as are worn by motorcyclists, are disclosed in, for example, U.S. Pat. No. 5,704,064 to van der Sleesen, U.S. Pat. No. 4,608,175 to Miller et al., and U.S. Pat. No. 5,105,477 to Golde.

Van der Sleesen discloses a ventilated garment which includes one or more vent openings in an outer panel, with an adjustable cover element disposed either on the outside of the garment or on the inside of the garment. The vent openings are spanned with a non-stretchable material, such as, for example, perforated leather. When the vent openings are uncovered to any extent, air can pass into the interior of the garment through the vent openings. Because the vent openings are spanned with a structural material, the vented portion of the garment does not increase in size or area when the vent openings are uncovered. This feature is considered advantageous to maintain the garment's close fit on the wearer, thereby enhancing the wearer's comfort and protection, as well as the aesthetic appeal of the garment.

Miller et al. discloses a ventilated garment which has vent openings which are spanned with a perforated material and a pair of ventilation opening strips which increase the spanned area of the vent opening beyond the dimensions of the garment when the vent openings are closed. This feature is considered advantageous to allow the vent opening to act as an air scoop so as to increase the airflow into the garment.

Golde discloses a ventilated garment which includes air scoops extending from the cuffs of the sleeves toward the wearer. The scoop includes an adjustable closure element such as zipper, an outer web of flexible air-impervious material extending between opposite edges of the opening of the scoop, and an inner web of an air-permeable material beneath the outer web. The forward (cuff) edges of the webs are not joined together but rather left free. Air flowing toward the arm can pass between the respective webs, thereby distending them to form an air scoop as the webs separate to let air pass therethrough.

SUMMARY OF THE INVENTION

In the present invention, several improvements are made to the existing designs. First, in ventilated garments which have a cover element adjustably covering the vent openings, the present invention features, in one embodiment, an adjustable cover element which is entirely removable from the garment. In another embodiment, the adjustable cover element is in the form of a removable pocket, purse or wallet for holding keys, money, identification, and the like.

Second, the ventilated garment of the present invention features adjustably closable air vents in the outer material of a garment, forming, for example, the sleeves of a jacket or the pant legs of a pair of trousers. The vents have opposing first And second edges which can be selectively joined along their length, and are disposed in any direction and on any portion of the sleeve or pant leg. Such first and second opposing edges optionally can extend along a linear or curvilinear axis of the garment. In a sleeve, the vents are preferably located approximately halfway up the inner side of the sleeve, adjacent the intended position of the wearer's inner elbow, to permit passage of air into the garment near the crook of the arm. In a pant leg, the vents are preferably located adjacent the wearer's knees toward the outside of the pant legs to permit passage of air into the garment's pant legs. Other locations for the vents are considered to be within the scope of the invention described herein.

A layer of a structural, substantially non-stretchable, air-permeable material underlies each vent, preferably extending from a region adjacent to the first opposing edge of the vent, and across the vent (i.e., transverse to the longitudinal axis of the vent) to at least a region adjacent the second edge of the vent. In a preferred embodiment, when the wearer's arms or legs are bent, such as when the wearer is riding a motorcycle, the opposing edges of the vent move apart by virtue of the orientation of the vented portion of the garment, thereby allowing air flow to pass through the structural, substantially non-stretchable, air-permeable material underlying the vent. The edges of the vent act as a scoop for air flow. In one preferred form of the invention, the air-permeable material extends in the general direction of the vent axis along substantially the entire length of the respective sleeve or pant leg, thereby providing a "tubular" air-permeable structure that permits dispersal of air flow through the vent and along the entire length of the respective sleeve or pant leg. One or both of the first and second opposing edges may be reinforced, or stiffened, for example with a bead, so that the "scoop" has a desired shape, to optimize effectiveness. The "scoop" is in part held open by the action of air passing therethrough, in part by the stiffness of the edge material, and in part by the orientation of the vented portion of the garment (e.g., bent sleeve or leg). An impermeable windshield flap may be affixed beneath one of the opposing edges of the vent opening and may extend over at least a portion of the vent opening when the opposing edges of the vent opening are disposed side by side.

Third, in ventilated garments which may include a fitted waistband, such as in jackets, vests and trousers, the present invention features an adjustable waistband which includes, in one embodiment, a unitary triangular gusset at the side seams, and integral with the side panels, of a garment near a waistband of the garment, and a circumferential tab portion of the waistband which extends across the gusset from the outer surface of the waistband through an opening in the waistband to a closure element, such as a hook and eye panel, on either the inside or outside surface of the waistband. Extension of the tab through the opening in the waistband, and anchoring of the tab at a desired location of the closure element, permits the garment to be adjusted for varying fits while minimizing garment bulk and discomfort to the wearer. In another embodiment, the gusset may have multiple sections which extend separately from one or both side panels of a garment. The circumferential tab extends across the gusset and gathers or cinches the sections of the gusset together, as the tab is anchored by a closure element disposed on the inside or outside surface of the waistband. A sectioned gusset is desirable if the material of the garment is particularly stiff and difficult to gather.

BRIEF DESCRIPTION OF THE DRAWINGS

FIG. 5A illustrates a ventilated garment having a pant leg vent according to another aspect of the invention;

FIG. 5B is an enlargement of the pant leg vent of FIG. 5A;

DETAILED DESCRIPTION OF THE DRAWINGS

Figure 1:
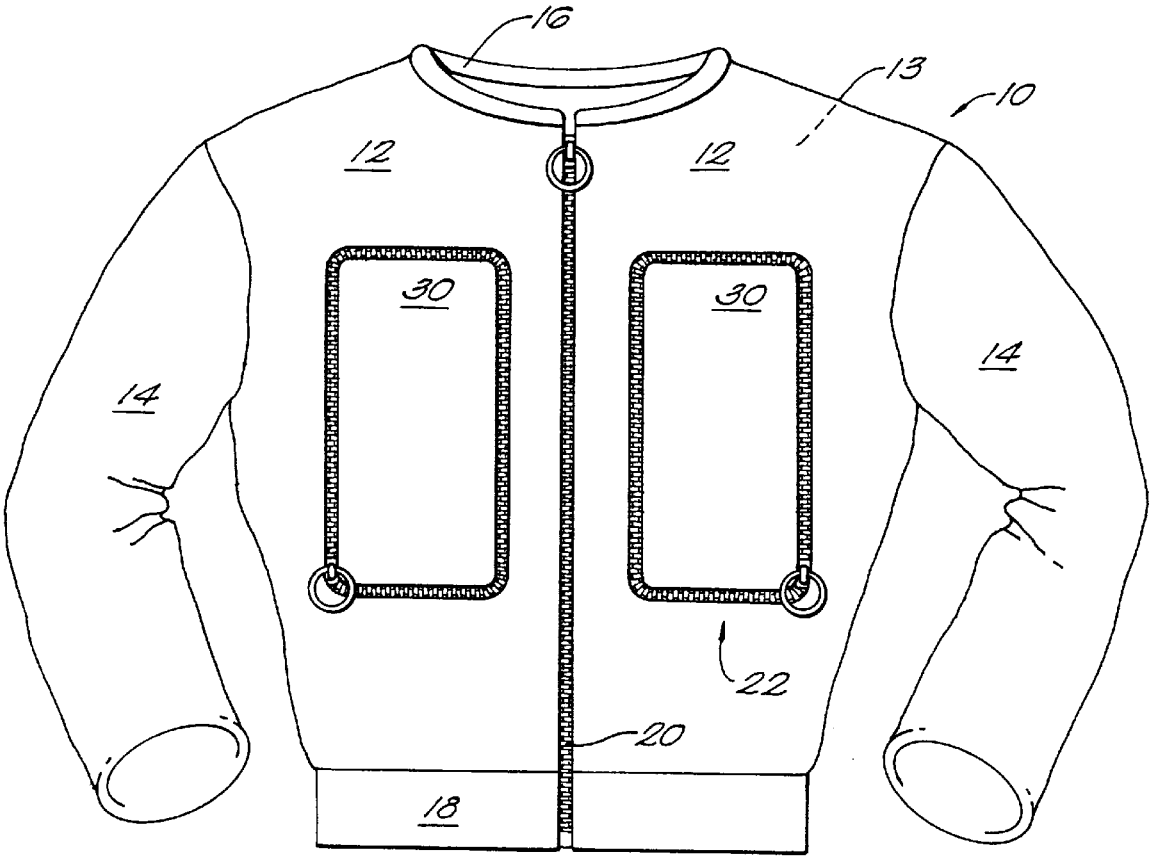
FIG. 1 illustrates a ventilated garment having removable vent cover elements according to one aspect of the invention.
Figure 2:
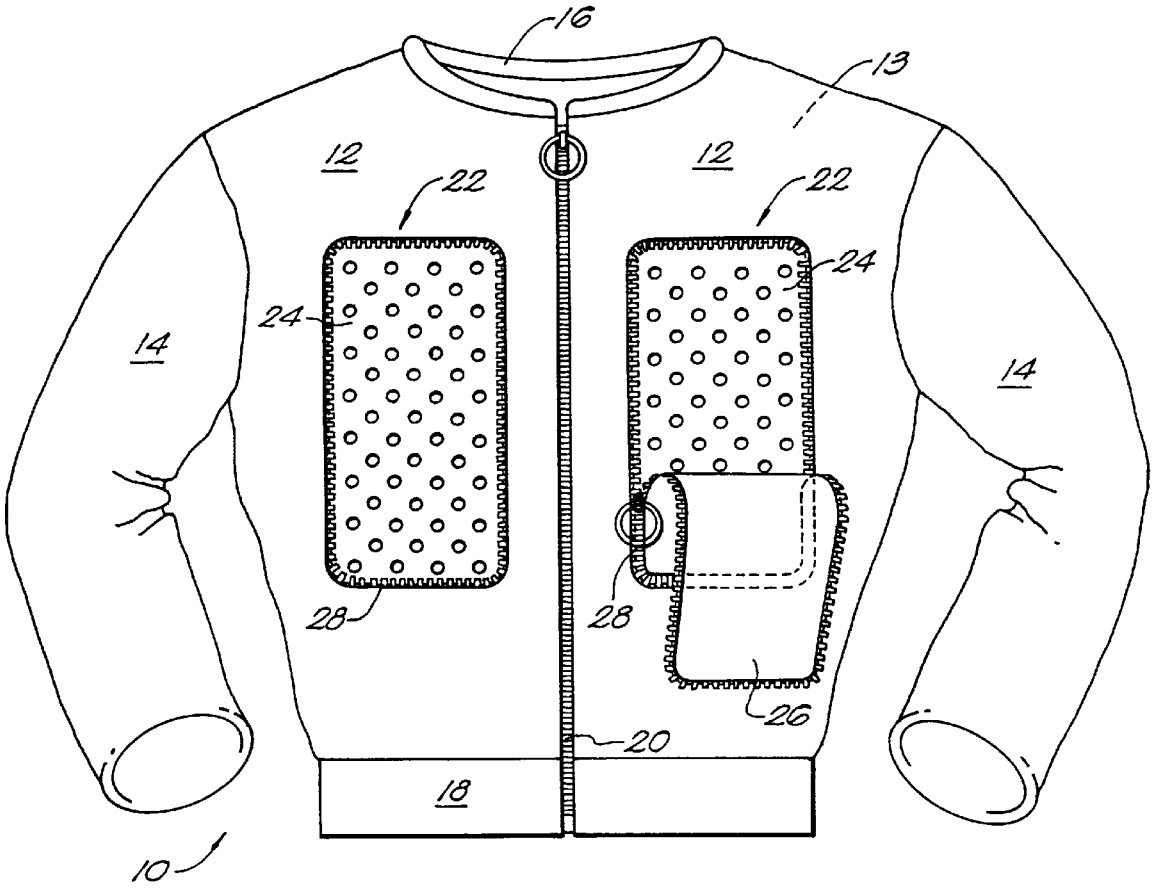
FIG. 2 illustrates a ventilated garment having a vent opening spanned with a structural, substantially non-stretchable, air-permeable material beneath the removable cover element.

A ventilated garment according to one aspect of the invention is shown in FIGS. 1 and 2. The illustrated garment 10 is shown as a jacket but could also be a variety of other garments, and preferably outer wear garments, such as, for example, a vest, a body suit or a pair of trousers. The illustrated garment 10 includes front panels 12, rear panels 13, sleeves 14, a collar 16, a waistband 18, and a front closure element 20, illustrated in this embodiment as a zipper. The front panels 12 include vent openings 22 spanned with a structural, substantially non-stretchable, air-permeable material 24 which permits air to pass into the garment from the outside. By way of example, the air-permeable material 24 can be perforated leather with a perforation pattern of relatively small holes compared to the interhole spacing.

The vent openings 22 are provided with a cover element 26 which can be adjustably positioned over all or a portion of the vent opening to vary the amount of air passing into the garment.

Figure 3A:
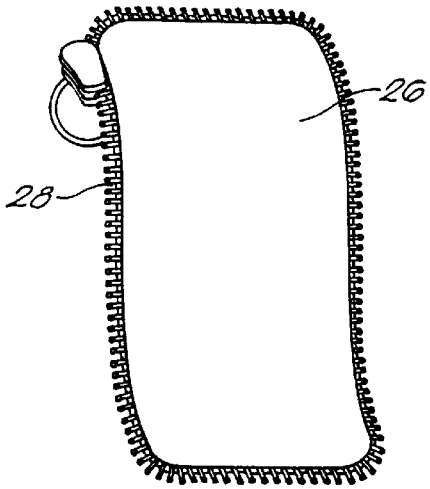
FIG. 3A illustrates one embodiment of a removable cover element which is essentially a flat cover panel.

According to an embodiment of the invention, the cover element 26 is a substantially two-dimensional cover panel, as shown in FIG. 3A. According to another embodiment of the invention, the cover clement 25 is a three-dimensional form having front 27 and rear 29 panels coupled together to define a relatively flat interior compartment 31, as shown in FIG. 3B. According to yet another embodiment of the invention, cover element 30 is three-dimensional form having front 27, rear 29 and side 33 panels coupled together to define an interior compartment 31, which has some depth, as shown in FIG. 3C.

Preferably, cover elements 25, 26 and 30 are removably attached to the periphery of the vent opening 22 in the front panel 12 by an adjustable closure clement 28, such as a zipper, a snap or a hook and loop fastener assembly. Thus, the cover element 25, 26 and 30 can be removed from the garment, folded up and placed in the pocket of the garment for later reattachment to the garment when the wearer wishes to cover up the vents.

Figure 3C:
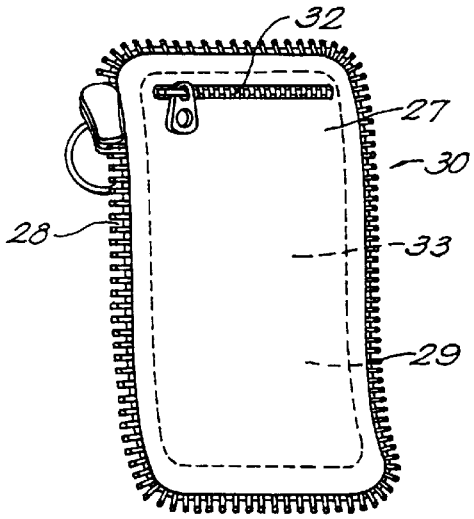
FIG. 3C illustrates still another embodiment of a removable cover element having front, rear and side panels defining an interior compartment.
Figure 3B:
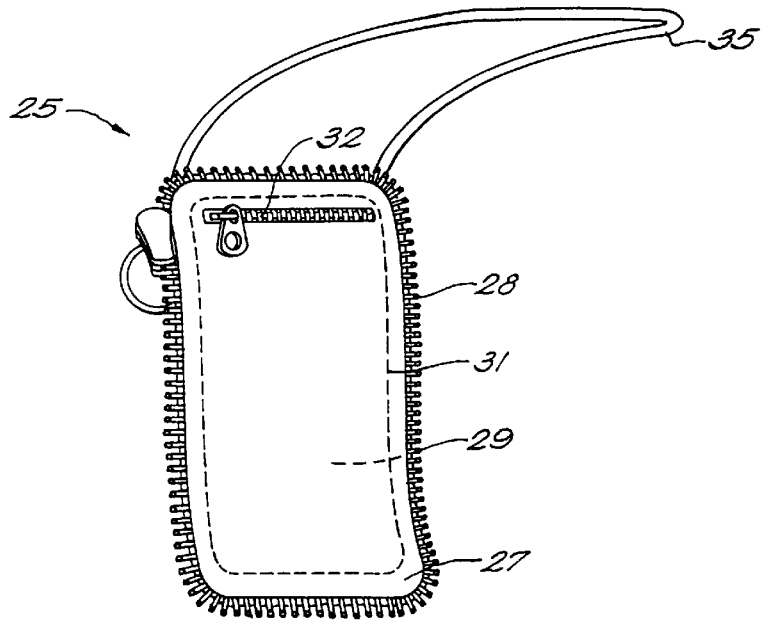
FIG. 3B illustrates another embodiment of a removable cover element having front and rear panels defining an interior compartment.

More preferably, th e access element 32 is located in one of the front 27, rear 29 or side 33 panels, as shown in FIGS. 3B and 3C. The access element 32 provides adjustable access to the interior compartment 31. The cover elements 25 and/or 30 can form a three-dimensional pocket, wallet or purse. The cover element 25 and/or 30 is preferably of a size and shape which fits conveniently into a pocket or bag, yet is large enough to store money, keys and the like. It is preferably minimally thick so that when it is attached to the garment it does not extend excessively from the front of the garment and obstruct the wearer's freedom of movement. It may include a detachable strap or belt loop 35 for convenience in carrying.

Removal of the cover elements 25, 26 or 30 from the garment 10 exposes the underlying vent openings 22 to their maximum airflow potential but does not otherwise affect the shape of the garment. The material 24 spanning the vent openings is preferably structural (i.e., non-stretchable) so that the garment substantially retains its size and shape regardless of the disposition of the vent cover elements.

Figure 4A:
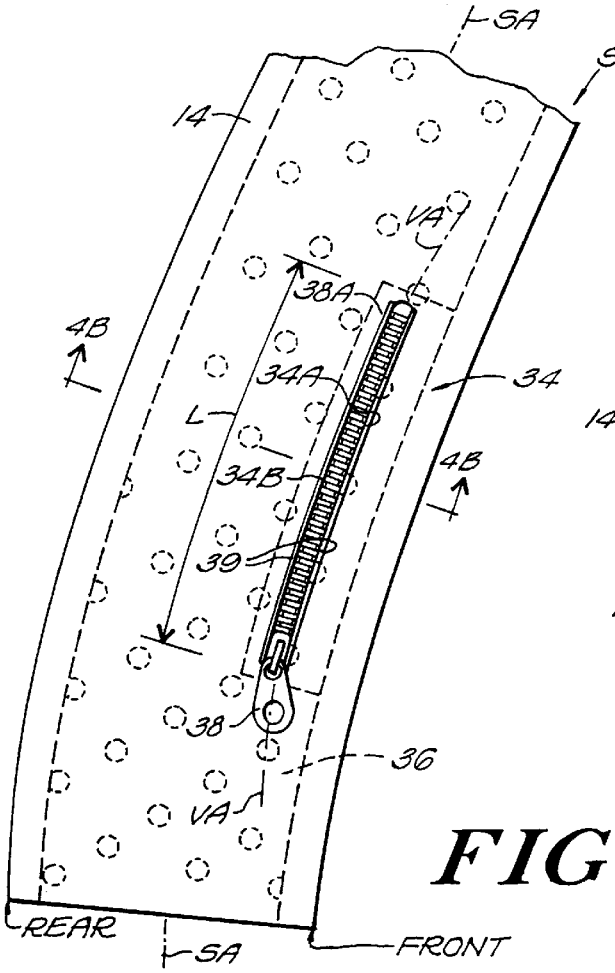
FIG. 4A illustrates a ventilated garment having a sleeve vent according to another aspect of the invention.
Figure 4B:
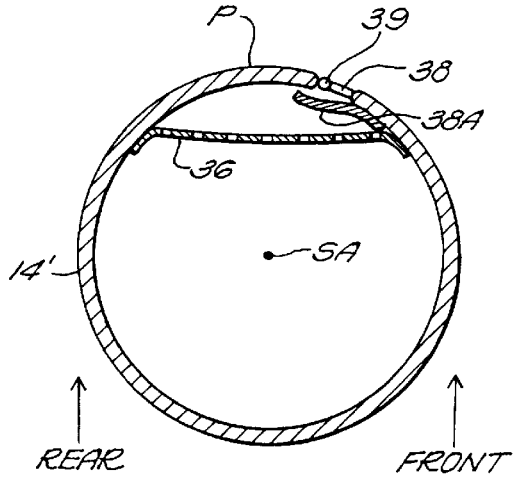
FIG. 4B illustrates a cross-section of the sleeve vent of FIG. 4A when closed.
Figure 4C:
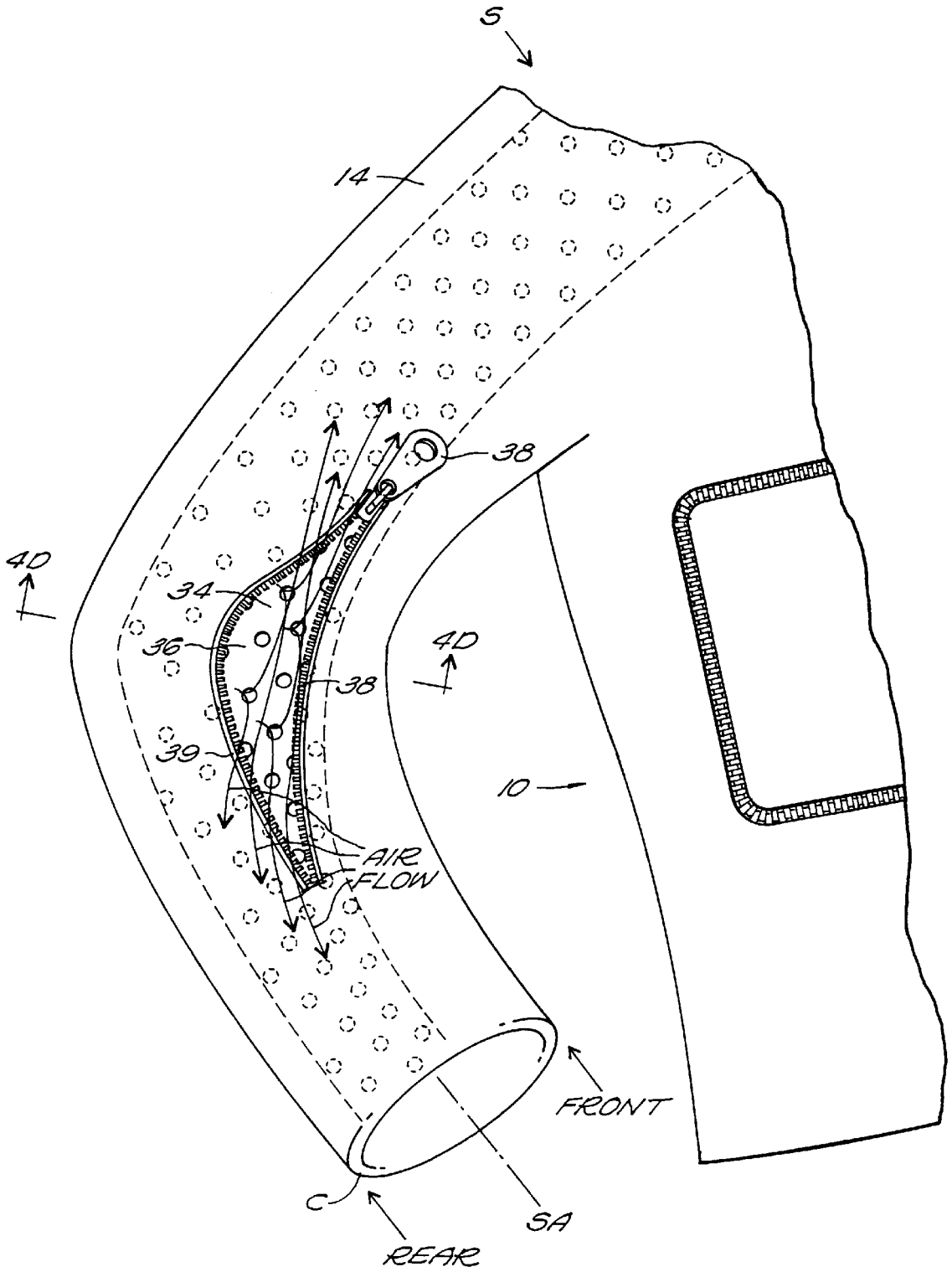
FIG. 4C illustrates a ventilated garment having an open sleeve vent.

According to another aspect of the invention, a ventilated garment, and preferably a ventilated outer wear garment, such as, for example, a jacket or a body suit, includes sleeves 14 which have vent openings 34, as illustrated in FIGS. 4A and 4C. The vent openings 34 can be disposed in any direction, and on any portion of the sleeve 14. Preferably, the vent openings 34 are disposed substantially longitudinally in the sleeve 14. Alternatively, the vent openings 34 are disposed substantially laterally in the portion of the sleeve 14. Preferably, the vent opening 34 is disposed at a point near the crook of the arm, approximately midpoint between the cuff C and the shoulder S, as shown most clearly in FIGS. 4A and 4C.

The vent openings 34 have first and second opposing edges 34A, 34B. Such opposing edges optionally can extend along a linear or curvilinear vent axis VA which is generally aligned with the central axis of the sleeve SA. As with the vent openings 22 in the front panels 12 of the garment, the vent openings 34 are spanned with a structural, substantially non-stretchable, air-permeable material 36 which permits passage of air into the garment without causing the garment to increase substantially in size.

As shown in FIG. 4A, the material 36 extends from a region near a first opposing edge 34A of vent opening 34, across the vent opening 34 and to at least a region on the other side of the vent opening 34 near second opposing edge 34B. A "scoop" is formed by the stand-up action of the opposing vent edges when the arm of the wearer is flexed. Alternatively, the vent opening 34 can overlie other regions of the air-permeable material 36, for example, a centrally located region.

In a preferred embodiment, the vent opening 34 is can be adjustably opened and closed with an adjustable closure element 38, such as a zipper, snap or a hook and loop fastener assembly, affixed to the opposing edges of the vent opening 34, so that the wearer can control the amount of ventilation into the sleeves 14 of the garment.

An optional air-impervious windshield element 38A extends from at least one of the opposing edges across at least a portion of the vent opening 34. When the vent opening 34 is closed, the windshield element 38A can extend across all or a portion of the vent opening 34. When the vent opening 34 includes an adjustable closure clement 38, the windshield clement 38A is disposed beneath the adjustable closure element 38 but over at least a portion of the air-penneable material 36. The air-permeable material 36, the windshield element 38A and an adjustable closure clement 38, such as a zipper, can all be stitched together with stitching to provide an air-impervious backing to the adjustable closure element 38 when it is closed. The windshield clement is preferably made of a non-permeable material, such as vinyl, leather or plastic, which resists penetration by air and moisture.

As shown in FIGS. 4A and 4C, the air-permeable material 36 underlying the vent openings 34 can extend substantially the full length of the sleeve. This construction permits air entering the opening at the crook of the arm to pass through the perforations of material 36, up the ann between the air-permeable material 36 and the sleeve 14 toward the armpit and torso of the wearer, as well as down the arm toward the hand, thereby providing cooling all along the arm. In a preferred embodiment, a strip of the air-permeable material 36 is stitched into the sleeve so that it forms a structural sleeve panel. In another preferred embodiment, the air-permeable material 36 is disposed in a region on the inside of the arm, adjacent the inside of the elbow, establishing an air-permeable "tunnel" configuration. In other configurations, the material 36 may not be uniformly air-permeable, but may have selected regions of permeability. In the embodiment of FIG. 4A, the air-permeable tunnel (formed by the air-permeable material 36 and the inner surface of the sleeve 14) can include ribs or stent-like internal structures to maintain a desired tunnel opening throughout or at various locations along the sleeve.

The preferred location of the vent openings 34 at approximately the midpoint of the sleeve 14, near the crook of the arm or the inside of the elbow, is especially advantageous as it employs the natural position of the wearer's arm to maximize cooling airflow into the garment from the sleeve. When the wearer is riding a motorcycle, the arms are naturally slightly bent as the wearer grips the handlebars. This slight bend in the arms causes the edges of the vent openings to separate from each other, thereby forming an air scoop which funnels air into the garment. The presence of a structural, substantially non-stretchable, air-permeable material across the opening maintains the shape and size of the sleeve and prevents stretching of the sleeve when air is passing into it. When the arm is straightened, such as when the rider dismounts the vehicle, the edges of the vent opening can approach each other, which narrows the opening and limits the amount of air which can pass into the sleeve.

In the illustrated form of the invention, one or both of the opposing edges may include a reinforcement, preferably in the form of a relatively stiff bead or other stiffener 39 running along its length. With the reinforcement, the shape of the "scoop" is well defined when the vent opening 34 is open (and the sleeve of the garment is bent at the elbow). In other embodiments, no forms of stiffeners are used.

Figure 4D:
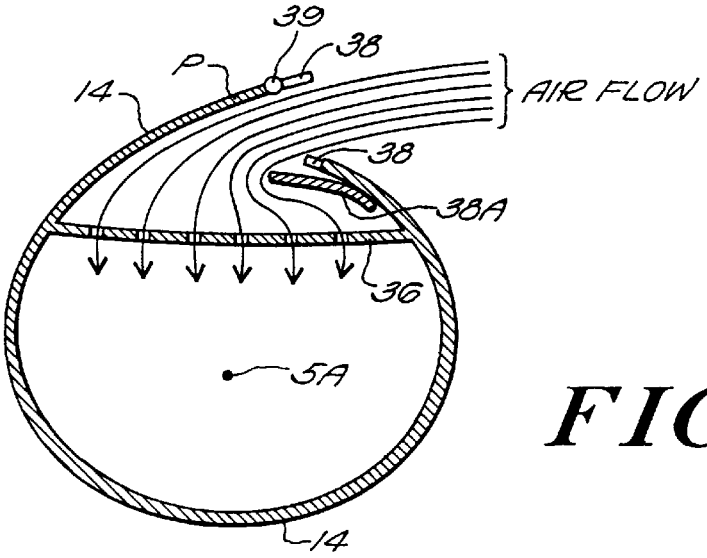
FIG. 4D illustrates a cross-section of the sleeve vent of FIG. 4C.

FIG. 4B is a section view of the ventilated sleeve when the vent opening 34 is closed. FIG. 4D is a section view of the ventilated sleeve when the vent opening 34 is opened. The arrows A show the direction of airflow into the garment and through the air-permeable material 36.

Figure 4E:
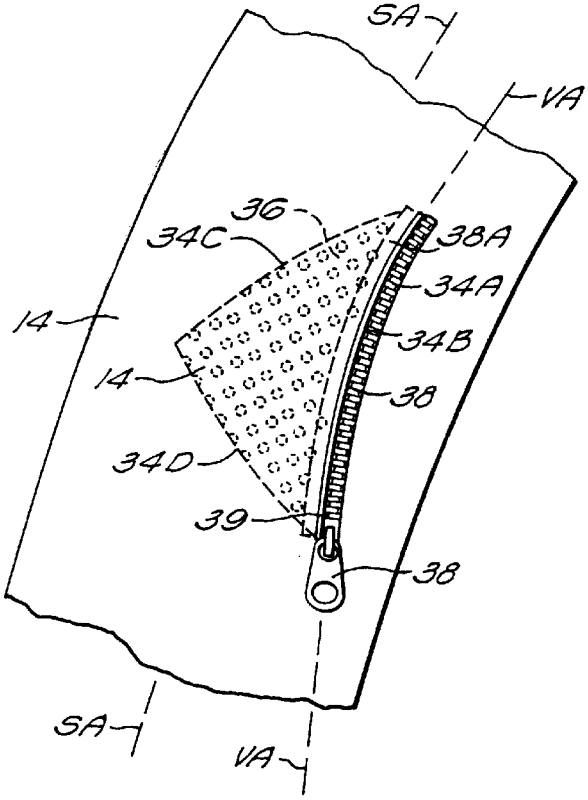
FIG. 4E illustrates an elbow portion of a sleeve in an alternate form of the invention.

FIG. 4E shows an alternate embodiment, wherein the air-permeable material 36 underlying the vent opening 34 has a more limited extent compared to the corresponding element in FIG. 4A. In FIG. 4E, the air-permeable material 36 has a generally triangular shape, being sewn to first opposing edge 34A on one side, and extending from that edge 34A, across the vent 34, and joined to the sleeve 14 at contours 34C and 34D. In use, with the wearer's arm bent at the elbow, the opposing edges of the vent opening form an air scoop. As in FIG. 4A, a bead or other stiffener 39 optionally may be provided on one or both of the opposing edges 34A, 34B.

The structural, substantially non-stretchable, air-permeable material 24, 36 spanning the vent openings in the ventilated garment of the invention is illustrated in the FIGURES as a perforated non-stretchable material, such as perforated leather. However, other structural materials which arc or can be made air-permeable can also be used.

While illustrated above for vented sleeve of jackets or full body suits, the material can be used in other configurations. For example, a vent configuration can be used at the knee or inner thigh of pants or a full body suit, to provide ventilation to the user, for example, along the leg and to the crotch area.

Accordingly, in another aspect of the invention, the invention provides a ventilated outer wear garment, such as, for example, a pair of trousers or full body suit, including pant legs 52 having vent openings 54, as illustrated in FIGS. 5A and 5B. Such a vent opening 54 is shown disposed substantially longitudinally in a region located on the outside of a knee K of the pant leg 52. In other embodiments, the vent openings 54 can be disposed in other directions, i.e., substantially laterally, and in other regions of the pant leg, such as, for example, in the thigh region of the pant leg 52.

The vent openings 54 have first and second opposing edges 56A, 56B. The vent openings 54 optionally can extend along a vent axis VA which is generally aligned with the longitudinal axis PA of the pant leg. The vent openings 54 are spanned with a structural, substantially non-stretchable, air-permeable material 58 which permits passage of air into the garment without causing the garment to increase substantially its size.

As shown in FIG. 5A, the substantially non-stretchable, air-permeable material 58 extends from a region near a first opposing edge 56A of vent opening 54, across the vent opening 54 and to at least a region on the other side of the vent opening 54 near the second opposing edge 56B. A "scoop" is formed by the stand-up action of the opposing vent edges when the knee of the wearer is bent. Alternatively, the vent opening 54 can overlie other regions of air-permeable material 58 as, for example, a centrally located region.

In a preferred embodiment, the vent opening 54 is adjustably closed or opened with an adjustable closure element 60, such as a zipper, snap, or a hook and loop fastener assembly, affixed to first and second opposing edges 56A, 56B of the vent opening 54, so that the wearer can control the amount of ventilation into the pant leg 52 of the garment.

An optional air-impervious windshield element 62 extends from at least one of the first and second opposing edges across at least a portion of the vent opening 54. When the vent opening 54 is closed, the windshield element 62 can extend across all or a portion of the vent opening 54. When the vent opening 54 includes an adjustable closure element 60, the windshield element 62 is disposed beneath the adjustable closure element 60 but over at least a portion of the air-permeable material 58. The air-permeable material 58, the windshield element 62, and the adjustable closure element 60, such as a zipper, can be stitched together with stitching to provide an air-impervious backing to the closure element 60 when the adjustable closure element 60 is closed.

As shown in FIGS. 5A and 5B, the air-permeable material 58 underlying the vent openings 54 can extend along a substantial length of the pant leg 52. This construction permits air entering the opening at the bend of the knee to pass through the perforations of air-permeable material 58, up the leg towards the waist and down the leg towards the foot between the air-permeable material 58 and the pant leg 52, thereby providing cooling all along the leg. In a preferred embodiment, a strip of the air-permeable material 58 is stitched into the pant leg 52 so that it forms a structural vent panel on the inner surface of the pant leg. In another preferred embodiment, the air-permeable material 58 is disposed preferably adjacent a side of the knee, establishing an air-permeable "tunnel" configuration. In other configurations, the air-permeable material 58 may not be uniformly air-permeable, but may have selected regions of permeability. In the embodiment of FIGS. 5A and 5B, the air-permeable tunnel (formed by the air-permeable material 58 and the inner surface of the pant leg 52) can include ribs or stent-like internal structures to maintain a desired tunnel opening throughout or at various locations along the pant leg.

Similar to the preferable location of the vent openings 34 at approximately the midpoint of the portion of the sleeve 14 described above, the preferable location of the vent openings 54 near the knee is especially advantageous as it employs the natural position of the bent knee to open the vents and to maximize cooling airflow into the garment. When the wearer is riding a motorcycle, the knees may be bent causing the opposing edges of the vent opening 54 to separate from each other, thereby forming an air scoop which funnels air into the garment. The presence of the structural, non-stretchable, air-permeable material across the opening maintains substantially the shape and size of the pant leg and prevents stretching of the pant leg when air is passing into it. When the leg is straightened, the edges of the vent opening can approach each other, which narrows the opening and limits the amount of air which can pass into the pant leg.

In the illustrated form of the invention, one or both of the opposing edges may include a reinforcement, preferably in the form of a leather bead or other stiffener 59 running along its length. With the reinforcement, the shape of the "scoop" is well defined when the vent is open (and the leg of the garment is bent at the knee). Alternatively, no stiffeners are used.

While illustrated above for the vented sleeve of a jacket or full body suits, or the vented pant leg of a pair of trousers or a full body suit, the invention can be used in other configurations. In non-limiting examples, vents similar to those of the present invention can be used on one or both of the thigh regions of a pair of pants or a full body suit or on one or both of the shoulders of a jacket or a full body suit, to provide passive ventilation for the user. In other non-limiting examples, vents similar to those of the invention can be oriented along longitudinal axes which lie substantially in lengthwise directions along the body of the wearer, along transverse axes which lie substantially across the body of the wearer, along diagonal axes, along curvilinear axes or along any other axes suitable for effecting the objectives of the invention. Such vents may not necessarily open and close in response to the orientation of those portions of the garment.

Figure 6A:
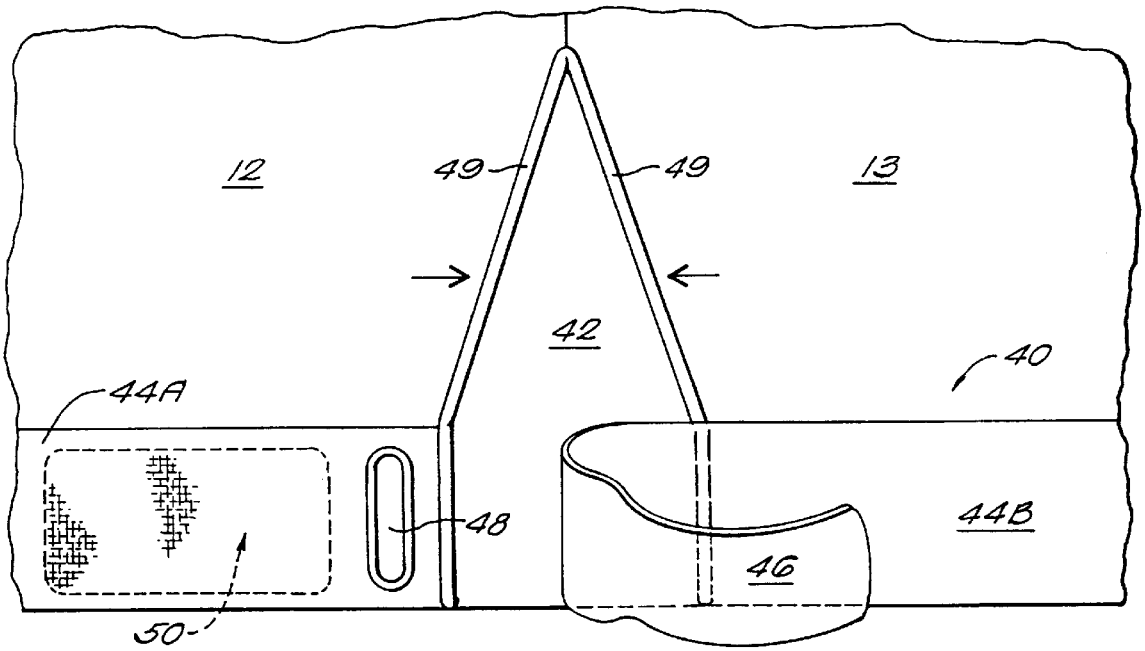
FIG. 6A illustrates a ventilated garment having an adjustable waistband with a unitary gusset according to still another aspect of the invention, in which the gusset is fully extended.
Figure 6B:
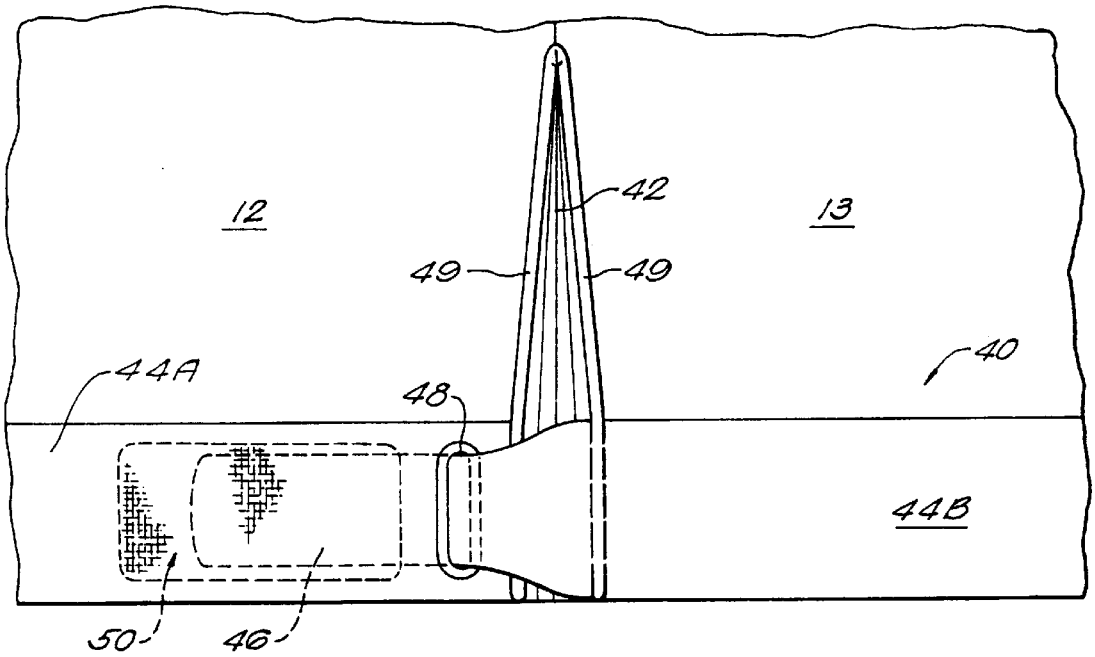
FIG. 6B illustrates the garment of FIG. 6A, in which the waistband is clinched to a desired fit, thereby collapsing the gusset.

According to another aspect of the invention, a garment such as is described above in connection with FIGS. 1–4C includes an adjustable waistband 40. As shown in FIGS. 6A–6C, the garment can be a jacket or vest or a pair of trousers and includes a front panel 12, a rear panel 13, a gusset 42 disposed between a portion of the front and rear panels, and a waistband 44. The gusset 42 is collapsible and provides adjustability in the girth of the garment as the waistband 44 is clinched about the wearer or let out. The waistband 44 has a front portion 44A and a rear portion 44B. One of those portions includes a tab 46 which is extendable into an opening 48 in the other portion as shown in the FIGURES so as to be drawn alongside and parallel to the other portion of the waistband. The end of the tab 46 and the inside of the opposite portion of the waistband toward which the tab 46 extends are provided with a closure element 50, such as, for example, a buckle, hooks and eyes or a hook and loop strip, to lock the waistband at a particular girth.

In a preferred embodiment, the tab 46 is an extension of the rear portion 44B of the waistband and extends toward the front portion 44A of the waistband so that the wearer can easily adjust the girth of the garment. It is preferred to have the tab 46 pass from the outside of the garment to the inside, for a more streamlined look and fit. Placement of the closure element on the inside of the waistband instead of the outside protects it against inadvertent opening by movement of the wearer's arm or by passing objects.

The gusset 42 can be made in any shape which contributes adjustability of fit to the garment while being collapsible when the waistband is clinched about the wearer. In FIG. 6A the gusset is a triangular piece of material which is preferably the same material as that of the garment panels, so as to provide like protection and air-impermeability. FIG. 6B illustrates the gusset in a collapsed state as the waistband is clinched about the wearer and the tab 46 locked in position with closure element 50. Preferably, a reinforcement, for example, a leather bead 49, is affixed to the edges of gusset 42, so that in use, the edges of the gusset are maintained substantially in a desired (e.g., straight) shape, regardless of the position of affixation of element 46 to element 50 or the bunching of the gusset.

I claim:

1. A ventilated garment, including an outer panel having at least one vent region with one or more openings therein, a substantially non-stretchable, air-permeable vent material spanning the openings of the vent region, at least one air-impermeable cover element disposed over the openings of the vent region, and an adjustable closure element for adjustably coupling at least a portion of the cover element to the outer panel, wherein the cover element comprises a front panel and a rear panel, the front and the rear panels being attached to each other to define an interior compartment of the cover element, and wherein the cover element includes an access element for providing access into the interior compartment.

2. A ventilated garment according to claim 1, wherein the access element includes an adjustable closure element.

3. A ventilated garment according to claim 2, wherein the adjustable closure element is selected from the group consisting of a zipper, a snap, and a hook and loop fastener.

4. A ventilated garment according to claim 1, wherein the cover element is made from a substantially air-impermeable material.

5. A ventilated garment according to claim 1, wherein the cover element is disposed on the inside of the garment.

6. A ventilated garment according to claim 1, wherein the cover element is disposed on the outside of the garment.

7. A ventilated garment according to claim 1, wherein the cover element includes at least one side panel attached to and joining the front and the rear panels.

8. A ventilated garment according to claim 1, wherein at least one of the side panels includes an access element for providing access into the interior compartment of the cover element.

9. A ventilated garment according to claim 8, wherein the access element includes an adjustable closure element.

10. A ventilated garment according to claim 9, wherein the adjustable closure element is selected from the group consisting of a zipper, a snap and a hook and loop fastener.

11. A ventilated garment according to claim 1, wherein the cover element includes a detachable strap for carrying the cover element.

12. A ventilated garment according to claim 1, wherein the outer panel is made from a substantially non-stretchable material.

13. A ventilated garment comprising an outer panel disposed about and defining an interior region, the outer panel having at least one vent region having a vent opening for permitting air flow through the outer panel into the interior region of the garment, the vent opening having first and second opposing edges and having a substantially non-stretchable, air-permeable vent material spanning the vent opening, the vent region defining an airflow scoop which selectively controls airflow into the garment as a function of the orientation of the vent region of the garment.

14. A ventilated garment according to claim 13, further comprising an adjustable closure element affixed to the first and the second opposing edges of the vent opening for adjustably coupling the opposing edges.

15. A ventilated garment according to claim 14 wherein the adjustable closure element is selected from the group consisting of a zipper, a snap, and a hook and loop fastener.

16. A ventilated garment according to claim 14, further comprising an air-impermeable windshield element affixed between at least one of the opposing edges and the air-permeable vent material and extending transversely over at least a portion of the vent material.

17. A ventilated garment according to claim 13, wherein the vent material includes a plurality of openings which are small relative to the spacing between adjacent openings.

18. A ventilated garment according to claim 17, wherein the vent material includes a plurality of uniformly spaced openings.

19. A ventilated garment according to claim 17, wherein the vent material includes a plurality of non-uniformly spaced openings.

20. A ventilated garment according to claim 13, wherein the vent opening extends for a length L, and the vent material extends a substantial distance beyond the length L of the vent opening.

21. A ventilated garment according to claim 13, wherein the outer panel is made from a substantially non-stretchable material .

22. A ventilated garment according to claim 13, wherein the garment includes sleeves, and wherein the vent material is disposed along the inside of a sleeve adjacent the inner elbow region of the sleeve and extends along at least a portion of the sleeve, wherein the airflow scoop is open when the sleeve of the garment is bent, and substantially closed when the sleeve of the garment is substantially straight.

23. A ventilated garment according to claim 22, wherein the vent material extends along substantially the entire length of the sleeve.

24. A ventilated garment according to claim 13, wherein the garment includes pant legs, and wherein the vent material is disposed on the inside of a leg adjacent the knee region of a leg and extends along at least a portion of the inside of the leg of the garment, wherein the airflow scoop is open when the leg of the garment is bent, and substantially closed when the leg of the garment is substantially straight.

25. A ventilated garment according to claim 24, wherein the vent material extends along substantially the entire length of the leg of the garment.

* * * * *